US011620893B1

(12) United States Patent
Wade et al.

(10) Patent No.: US 11,620,893 B1
(45) Date of Patent: Apr. 4, 2023

(54) HUMAN AWARENESS TELEMETRY APPARATUS, SYSTEMS, AND METHODS

(71) Applicant: The Government of the United States of America, as represented by the Secretary of the Navy, Arlington, VA (US)

(72) Inventors: Michael Wade, Ijamsville, MD (US); Garry E. Shields, Ashburn, VA (US); Zbigniew J. Karaszewski, McLean, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 17/397,166

(22) Filed: Aug. 9, 2021

Related U.S. Application Data

(63) Continuation of application No. 16/993,848, filed on Aug. 14, 2020, now Pat. No. 11,113,942.

(51) Int. Cl.
*G08B 21/02* (2006.01)

(52) U.S. Cl.
CPC ..... *G08B 21/02* (2013.01)

(58) Field of Classification Search
None
See application file for complete search history.

(56) References Cited

U.S. PATENT DOCUMENTS

2016/0292988 A1* 10/2016 McCleary ..... G08B 21/0446
2018/0108236 A1* 4/2018 Kanukurthy ..... A62B 9/006

* cited by examiner

*Primary Examiner* — Thomas S McCormack
(74) *Attorney, Agent, or Firm* — Dawn C. Russell; Jesus J. Hernandez

(57) ABSTRACT

Systems and apparatus are provided for monitoring and/or collecting data regarding environmental conditions and optionally personal health information, and generating warnings for a wearer based on acceptable limits for hazards. Using the collected data, the systems and apparatus communicate recommendations to the wearer to improve or maintain personal safety in the detected environment. Methods for monitoring environmental risks and generating warnings based on acceptable limits for hazards are also provided.

15 Claims, 11 Drawing Sheets

HUMAN AWARENESS TELEMETRY APPARATUS, SYSTEMS, AND METHODS

RELATED APPLICATION DATA

This patent application is a continuation of U.S. patent application Ser. No. 16/993,848, filed on 14 Aug. 2020. The entire contents of this application are incorporated herein by reference.

FIELD OF THE INVENTION

The invention is directed to systems and apparatus for monitoring and/or collecting data regarding environmental conditions and optionally personal health information, and generating warnings for a wearer based on acceptable limits for hazards. Using the collected data, the systems and apparatus communicate recommendations to the wearer to improve or maintain personal safety in the detected environment. Methods for monitoring environmental risks and generating warnings based on acceptable limits for hazards are also provided.

BACKGROUND OF THE INVENTION

Traditionally, working conditions within a naval industrial facility, or onboard a ship, are assessed by roving industrial hygienists or safety inspectors. These assessments are normally conducted at the beginning of a work shift. Additional in situ assessments during a particular work shift will only be undertaken if prompted by an employee, or supervisor, who suspects that the working conditions have changed dramatically since the last assessment.

The Occupational Safety and Health Administration (OSHA) and other organizations have established Occupational Exposure Limits (OELs) for a large number of hazards. OHSA's Permissible Exposure Limits (PELs) for approximately 500 hazardous substances are found in 29 C.F.R Part 1910 Subpart Z (General Industry; Marine Terminals and Longshoring both incorporate the General Industry standards), 1915 Subpart Z (Shipyard Employment), and 1926 Subparts D and Z (Construction). Most OSHA PELs are based on 8-hour time-weighted averages (TWAs), as well as Ceiling and Peak limits, with additional skin contact designations. The OSHA PELs applicable to various hazards are incorporated herein by reference in their entirety.

However, OSHA acknowledges that many of its limits are outdated, and that there are many substances for which it does not have workplace exposure limits. To fill these gaps, National Institute for Occupational Safety and Health (NIOSH) uses an Occupational Exposure Banding process to manage risks, which includes providing Recommended Exposure Limits (RELs) for hazards that do not have OELs. For example, NIOSH offers its Pocket Guide to Chemical Hazards. The American Conference of Governmental Industrial Hygienists (ACGIH) is a professional association that has developed Threshold Limit Values (TLVs) and Biological Exposure Indices (BEIs) to assist in managing occupational health hazards. All of these guidelines and limit values for various hazards are also incorporated herein by reference in their entirety.

The Department of the Navy complies with OSHA standards for nonmilitary-unique operations and workplaces. Uniquely-military workplaces are excluded from regulatory standards distributed by OSHA, but OSHA and other regulatory safety and health standards are applied as practicable. When compliance with existing OSHA standards is impracticable or inappropriate, the DOD Safety and Occupational Health (SOH) Program requires application of risk management procedures. DoD Instruction 6055.01.

Although various health and safety standards may be applicable in workplaces, biomedical data from individual workers, Sailors, and Marines working in those environments has not traditionally been collected due to privacy concerns. Current methods for the collection and analysis of worksite environmental, situational awareness, and biomedical data have two major drawbacks.

The first major drawback is comprised of three distinct risk components.

The first risk component is that this responsibility has, in most cases, been delegated to inspectors and industrial hygienists. The knowledge, skills and abilities of these inspectors and hygienists can vary and lead to safety data being collected improperly or inconsistently. The result of this approach is that it places a disproportionate amount of the responsibility for a worker's safety onto personnel who are not directly responsible for performing the work. The ability to collect and analyze this type of data does not reside with the individual worker, Sailor, or Marine.

The second risk component stems from safety personnel who are tasked with analyzing the safety data collected in the field and communicating the results back to the workforce. The risk lies in how well these personnel process the safety data into usable information and how effectively the information is communicated. The analysis of safety data is generally performed by a group of trained safety personnel to whom the field safety inspectors report. This approach induces a lag time between when the data is collected and when the results are communicated to the workforce. This lag time can disrupt the timely completion of work at the job site and/or expose the worker to new potential hazards. Workers may also choose to take unnecessary risks as a result of not having usable safety information delivered to them in a timely fashion.

The third risk component originates with the workers, Sailors and Marines themselves. Once safety information is made available to members of the workforce, they are left to interpret the information using their own set of personal safety evaluation factors. These factors are usually based upon prior work experience, safety training, risk perception, personal risk tolerance and real-world influences. These factors can create large safety awareness gaps among workforce members, because they are based on each worker's personal interpretation of corporate-provided safety information.

The combined effect of all three of these risk components creates a formidable obstacle towards leveraging available technology to better equip individual workers, Sailors and Marines to make well-informed personal safety decisions.

The second major drawback is found in the practice of employing a series of static 'snapshots,' whereby workplace health and safety data is collected at set points in time over the course of a normal workday. There is no existing capability to continuously monitor and evaluate potentially hazardous conditions, particularly within high-risk shipboard workspaces. Conditions within these high-risk workspaces can change rapidly. In some cases, working conditions can go from 'safe' to 'unsafe' in a matter of minutes. The lack of continuous monitoring capability can result in workers unknowingly entering an unsafe work area that was deemed safe earlier in the same work shift. It can also have the opposite effect by triggering an unwarranted work stoppage due to the suspicion of hazardous conditions. This situation forces the workspace to be evacuated until an inspection can be performed to ascertain the presence of any real safety or health hazards.

The inability to properly and consistently assess workplace environmental conditions can create a significant level of distrust between members of the workforce and safety officials. This lack of trust can turn into skepticism that if left unchecked, can eventually lead to complacency and lack of situational awareness. Workforce complacency towards safety correlates to a much higher likelihood of sustaining an injury or causing an accident.

Accordingly, there is a need in the art for apparatus, systems, and methods that can provide warnings to workers regarding potentially-hazardous conditions that are tailored to workers' individual risk profiles, and changing environmental conditions in the workplace.

SUMMARY OF THE INVENTION

The invention described herein, including the various aspects and/or embodiments thereof, meets the unmet needs of the art, as well as others, by providing systems and apparatus for monitoring and/or collecting data regarding environmental conditions and optionally personal health information, and generating warnings for a wearer based on acceptable limits for hazards. Using the collected data, the systems and apparatus communicate recommendations to the wearer to improve or maintain personal safety in the detected environment. Methods for monitoring environmental risks and generating warnings based on acceptable limits for hazards are also provided.

In a first aspect of the invention, apparatus are provided for detecting workplace hazards and alerting a worker, including a user interface with a visual display system; an integrated circuit card including environmental hazard sensors, health hazard sensors, a controller programmed to compare data from the environmental hazard sensors and health hazard sensors with safety thresholds for each environmental hazard and health hazard, and determine if a safety threshold has been exceeded for each environmental hazard and health hazard, and a transmitter configured to transmit alerts based on each safety threshold that is exceeded. The alerts are visual alerts displayed by the visual display system.

In another aspect of the invention, systems are provided for detecting workplace hazards and alerting a worker, including a user interface configured to communicate an alert; and a sensor platform including environmental hazard sensors, health hazard sensors, a controller programmed to compare data from the environmental hazard sensors and health hazard sensors with safety thresholds for each environmental hazard and health hazard, and determine if a safety threshold has been exceeded for each environmental hazard and health hazard, and means for transmitting an alert to be communicated by the user interface based on each safety threshold that is exceeded. The user interface communicates the alert to the worker.

In a further aspect of the invention, methods are provided for issuing workplace hazard alerts to a worker, including providing sensors to monitor one or more environmental hazards associated with the workplace; providing sensors to monitor one or more health hazards associated with the worker assigned to the workplace; receiving data from environmental hazard sensors and health hazard sensors; comparing the data from the environmental hazard sensors and health hazard sensors with safety thresholds for each hazard and determining when a safety threshold is exceeded; and communicating an alert to the worker when a safety threshold for an environmental hazard or health hazard is exceeded.

Other features and advantages of the invention will become apparent to those skilled in the art upon examination of the following or upon learning by practice of the invention.

DETAILED DESCRIPTION OF THE INVENTION

Figure 1:
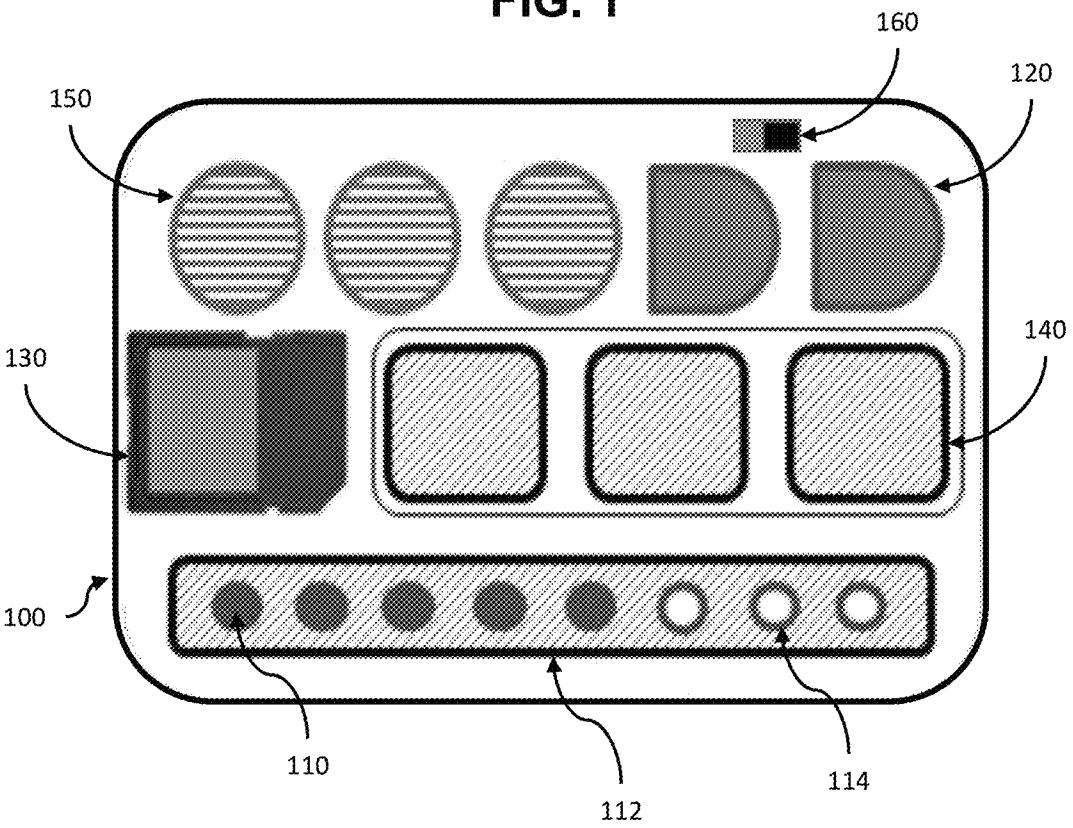
FIG. 1 depicts the integrated circuit card (ICC) apparatus of the invention, including integrated sensing, storage, power, data transmission, and processing capabilities.

The invention encompasses systems and apparatus for monitoring and/or collecting data regarding environmental conditions and optionally personal health information, and generating warnings for a wearer based on acceptable limits for hazards. Using the collected data, the systems and apparatus communicate recommendations to the wearer to improve or maintain personal safety in the detected environment. Methods for monitoring environmental risks and generating warnings based on acceptable limits for hazards are also provided.

The warnings may be generated, for example, based on acceptable limits for hazards and further in view of environmental conditions and personal vital statistics. Using the collected data, the systems and apparatus may also optionally communicate recommendations to the wearer and/or a remote health monitor to improve or maintain personal safety in the detected environment.

The apparatus, systems, and methods of the invention beneficially empower the individual worker, Sailor, or Marine to take charge of their own personal safety, thereby preventing complacency regarding workplace hazards. Sharing the responsibility with the worker also helps to minimize the effect that social and institutional barriers have on maintaining a proper level of on-the-job situational awareness.

The apparatus, systems, and methods of the invention may also be used to avoid problems such as elevated risks resulting from aggregated, low-level hazards that do not individually warrant safety intervention.

The invention also overcomes issues of lack of worker compliance with warnings due to competing demands for attention and focus. The apparatus, systems, and methods of the invention may be beneficially used to provide safety alerts to workers in a manner that takes into account industrial hygiene issues such as worker distraction and acclimatization to changes in the work environment. This may be accomplished, for example, by combining alert types (visual, audible, tactile), and limiting workers' ability to clear alerts.

In some aspects of the invention, the invention may be used to compare real-time biomedical data and environmental data against a worker's stored personal health profile, and can provide alerts or warnings targeted to the individual health considerations of the worker using the user interface. This comparison and resulting alerts can help the worker determine if their current physical condition exceeds personal boundaries or limits, such as those identified by trained medical or safety personnel.

The invention prevents safety issues that can occur when environmental conditions in a workspace change rapidly over the course of a work shift, in between routine safety checks. Shipyard workers frequently carry out their work in remote, enclosed spaces. This creates more potential for serious issues to arise than similar work carried out in open areas. For example, if a dangerous substance is generated in the environment as a result of the work being performed, it may build up in the environment at an exponential rate, and cross the maximum allowable threshold more quickly than in an open environment due to the inability to adequately ventilate the space. The apparatus, systems, and methods of the invention can account for this by tracking the instant and cumulative exposure to environmental hazards, and calculating a time interval when the hazard is predicted to exceed applicable safety thresholds. An alert can be provided with sufficient time remaining to allow the worker to remedy the problem or leave the worksite before conditions exceed applicable safety thresholds.

Although normally operated in a standalone mode, the invention can optionally also signal a potentially-developing problem to a remote safety staff member. This may be desirable, for example, if the worker is in a remote area where the response time may be extended, if the worker has repeatedly ignored or cleared warnings relating to hazards that exceed applicable safety thresholds, or if the data from one or more sensors (i.e., position sensors, heart rate sensors, respiration sensors) indicates that the worker may have become unresponsive or incapacitated.

The apparatus, systems, and methods of the invention may be configured to provide industrial Human Awareness Telemetry (iHAT). These iHAT configurations, which may include an integrated circuit card (ICC) and visual display system (VDS), can be tailored to particular industrial settings, such as shipyard tasks, and may be further customized based on the specific environment in which work is being performed, including applicable industrial, corporate, or individualized hazard and safety requirements. The selection of sensors used in the iHAT may also be customized for work in multiple fields, such as construction, heavy manufacturing, plant/factory engineering, mechanical system maintenance and repair, emergency response, chemical field services, biomedical, medical care, mining, automotive, and aerospace industries.

A first major advantage that the invention has over current practice is that it provides an individual worker, Sailor or Marine with a real-time environmental, situational awareness, and biomedical monitoring capability. The invention provides a robust in situ health and safety assessment capability that is in direct continuous contact with its human user. The human user has the ability to wait for the device to alert them regarding a specific environmental hazard or health-related condition, or they can proactively query any sensor on-demand to provide a real-time measurement as frequently as desired or required.

A second major advantage of the invention is that it is wearable and can go anywhere an individual worker, Sailor or Marine needs to go. It requires no data transmission infrastructure or outside service support as all monitoring capability can be self-contained. As there is no underlying requirement for the apparatus to act as a node on a network or have connectivity to a centralized data collection system, it can act independently and provide continuous health condition monitoring capability to a human user, regardless of physical location.

A third major advantage of the invention is that it provides personalized biomedical data to the human user without violating his/her right to privacy. The biomedical data is provided in real-time to the human user through the visual display system. None of the biomedical data is permanently stored or transmitted by the apparatus. This capability provides the human user with an unprecedented level of information regarding their physical health condition while on the job, but does not disseminate or share this information with anyone else. Workers, Sailors or Marines with pre-existing medical conditions, or returning to the job after an illness or injury, can monitor themselves closely in accordance with guidance provided by trained medical personnel.

The fourth major advantage is that the invention reduces the worker's dependency on third party inspectors and industrial hygienists. This allows the individual worker to minimize the amount of time they spend waiting to receive a safety determination report prior to starting, or continuing, work in a particular location. The worker can also "work smarter" by using available work time more effectively by using the apparatus to aid in making on-the-spot safety assessments.

The fifth advantage of the invention is an increase in employee morale and quality of work life. Providing a worker, Sailor, or Marine with reliable safety apparatus will give more control over personal workplace safety. This will strengthen the respect and trust between management and the workforce. Developing and deploying the systems, apparatus, and methods of the invention provides tangible evidence that individual employee safety and health are vitally important in the workplace.

Additional description of the apparatus, systems, and methods of the invention are provided herein.

Apparatus.

The apparatus of the invention generate safety recommendations and warnings based upon a comparative analysis of detected hazard levels and established industrial, corporate, and individualized hazard and safety requirements.

The apparatus of the invention may be used to monitor in situ conditions, and analyze at least four different types of environmental hazards: 1) physical; 2) biological; 3) chemical; and 4) radiological. The apparatus interrogates newly collected data against established near-term and long-term hazardous exposure limits. When used in the systems and methods of the invention, which provide accurate real-time post-processing of hazard data, the apparatus may be used to present safety information by way of visual, auditory, and/or tactile cues. The safety information may take a variety of forms, including, but not limited to, alerts indicating a hazard exceeds a safety threshold, warnings indicating that a hazard is approaching a level of concern with respect to a safety threshold, and status information based on current readings from one or more sensors.

In addition to the environmental hazards that are monitored, the vital signs of the wearer can be monitored to provide insight into the effects of the environment on the wearer, which may aid in identifying conditions that warrant immediate action. A worker can utilize the information to supplement their on-the-job decision making regarding their personal safety and health. The apparatus of the invention may also be configured to detect conditions where immediate emergency action is required, and transmit alerts to supervisors and safety staff.

Some jobs, such as those in industrial and medical fields, require a great deal of safety gear. The apparatus of the invention are designed to replace or be incorporated into existing items of safety gear, while minimizing any interference with the ability to perform work tasks. The apparatus of the invention may be incorporated, in whole or as individual components, for example, into safety glasses, visors, and hard hats, and incorporated into articles of clothing, or onto smartphones or tablets carried by the worker.

In some aspects of the invention, the apparatus includes two primary elements: a family of integrated circuit cards (ICCs); and a user interface. In other aspects of the invention, the apparatus is incorporated into a single unit, such as a user interface that incorporates the ICC (or its components) therein. The apparatus of the invention may optionally be configured to accept input from additional sources, such as smart watches, fitness trackers, wristbands, headbands, and smartphones. The apparatus may be configured to transmit safety information to these additional sources, in the form of visual, auditory, and/or tactile alerts.

FIG. 1 depicts an ICC 100 in accordance with the invention. The ICC 100 may include individual micro-electro-mechanical (MEMS) sensors 110, sensor mounts 112, and sensor apertures 114 to permit the sensors to be exposed to the environment. The ICC 100 also includes signal processing and wireless signal transmission elements 120; on-board and/or removable data storage 130; microcontrollers or microprocessors 140; one or more power sources 150; and optionally a hard-wired connection between the ICC and the user interface (not shown). The sensors 110 are preferably compatible with one another so that they can each function as part of the same integrated circuit. The sensors 110 provided on the ICC are preferably environmental sensors.

In some aspects of the invention, the ICC 100 is an industrially-hardened integrated circuit board configured to include multiple sensors. In some aspects of the invention, from about 4 about to 12 sensors are provided on the ICC, preferably from about 6 to about 10 sensors, more preferably about 8 sensors. The ICC 100 is preferably approximately the size of a credit card, but in some applications where additional sensors, data storage, or power capacity is needed, the ICC 100 may be approximately the size of an index card (i.e., from about 2-4" wide by about 3-6" long), though the invention is not limited by the size, shape, or configuration of the ICC, or the number or type of sensors, data storage, power sources, and processors or controllers provided thereon.

Preferably, each environmental sensor 110 selected for inclusion on the ICC 100 of the invention meets or exceeds the capabilities (i.e., sensitivity levels, reliability) of measurement methods already in use in a particular work environment. Where the ICC incorporates on-board storage, it may retain information regarding the environmental conditions in which the ICC has been used, or the stored data may be deleted at the end of each work shift.

The environmental sensors used in the apparatus of the invention may vary depending on the setting in which it will be used. The various sensors incorporated into the ICC are preferably self-calibrating, or can be calibrated with minimal user involvement. These environmental sensors may include, but are not limited to, physical sensors, biological sensors, chemical sensors, and radiological sensors.

Physical sensors may include, but are not limited to, temperature, humidity, noise (in decibels), GPS transmitters for position/location, visible light level, magnetic field sensors, vacuum sensors, pressure sensors, vibration sensors, and proximity sensors.

Biological sensors may include, but are not limited to, mold, viruses, bacteria, and other aerosolized biomolecules. Biological sensors to detect the presence of specific pathogens that may be encountered in a health care setting, such as SARS-CoV-2, may also be provided. Sensors to detect use of biological weapons, such as weaponized anthrax, may also be provided for workers, sailors, or marines working in dangerous locations.

Chemical sensors may include, but are not limited to, volatile organic compound levels, oxygen level, carbon dioxide level, carbon monoxide level, hydrogen sulfide, lower explosive limits, ammonia, chlorine, formaldehyde, sulfuric acid, and nitric acid. Chemical sensors may be selected to detect hazards that are typically present in a given industrial setting, for example, volatile organic compounds such as diesel marine fuel, mineral spirits, naphtha, xylene and butyl alcohol (which may be encountered, for example, in a shipyard). Additional sensors specific for the detection of other potentially-hazardous or regulated substances that may be present in a given work environment may be provided, including possible exposure to toxic substances used in chemical weapons (e.g., nerve agents).

Radiological sensors may include, but are not limited to, alpha, beta, gamma, and x-ray radiation detectors.

In some aspects of the invention, multiple ICCs may be configured for use together, for example, with certain types of sensors on one ICC and different types of sensors on another ICC. This may be beneficial, for example, when the one ICC monitors for common hazards, and a separate ICC is provided to augment the first ICC with sensors tailored to monitor for additional hazards (e.g., hazards that are not common in the workplace, but may be encountered in a specific environment or when performing a particular work task).

In additional aspects of the invention, a set of routine task ICC cards may be provided that all have the same suite of sensors. These ICCs may be assigned to most workers as they perform routine tasks around the worksite. For example, routine task ICC cards may be configured with sensors to detect oxygen, carbon monoxide, volatile organic compounds (such as butyl alcohol, solvent naphtha, xylene, mineral spirits, and diesel fuel marine), geolocation/GPS, and environmental or airborne noise.

In some aspects of the invention, the routine task ICC cards contain processors configured to provide alerts based on lower-risk situations where it is less likely that an environmental hazard will rapidly exceed acceptable limits, for example, due to being a confined space or having poor ventilation. For example, it may be acceptable to provide an alert when a sensor detects a hazard that is within 25%, preferably 20%, and more preferably 15% of an acceptable limit when in a low-risk environment. Risk settings may be adjusted by configuring the thresholds in the software executed by the processor prior to issuing the ICC to a worker for use in a work shift. In other aspects of the invention, the worker who has been issued the ICC as part of his work equipment may be able to adjust the ICC setting to provide alerts using a higher-risk threshold in view of personal safety preferences or individual health concerns that may not be known to others. This may be accomplished, for example, by providing a high-low risk setting switch 160 provided on the ICC.

The invention also supports providing multiple different types of specialized task ICC cards, where each set of specialized task ICCs has a unique suite of sensors. These specialized task ICC cards may be provided in smaller quantities than the routine task ICC cards, in order to reduce costs associated with providing specialized sensors not needed for routine tasks, and in view of the frequency with which workers need to perform those specialized tasks. For example, specialized task ICC cards may be configured with the basic sensors provided on routine task ICC cards, but may also include specialized sensors targeted to the specialized task or work location to detect hazards such as biological hazards, chemical hazards, and radiological hazards.

In some aspects of the invention, the specialized task ICC cards contain processors configured to provide alerts based on higher-risk situations where it is more likely that an environmental hazard will rapidly exceed acceptable limits, or where the employee is located far from assistance in case of an emergency. For example, it may be necessary to provide an alert when a sensor detects a hazard that is within 25%, preferably 35%, and more preferably 50% of an acceptable limit when in a high-risk environment. This may give the worker time to adjust worksite variables (such as ventilation) in time to avoid exceeding a hazard threshold (buildup of a toxic substance in an enclosed space), or may give the worker sufficient time to extricate himself from a remote environment or enclosed space before the hazard exceeds the safety threshold.

Each different set of ICCs (whether for routine or specialized tasks) is configured with sensors applicable to different work environments. Upon determining the work environment and task assigned to a given worker, the ICC having sensors pre-selected based on the hazards that may be present in that work location (e.g., confined space, biological, chemical, or radiological exposure), or associated with that work task (e.g., painting, sandblasting, welding) is provided to the worker along with other safety gear suited to the environment and task. The use of different sets of ICCs may be beneficial, for example, when a workplace has a variety of work environments that pose unique sets of risks.

Figure 2:
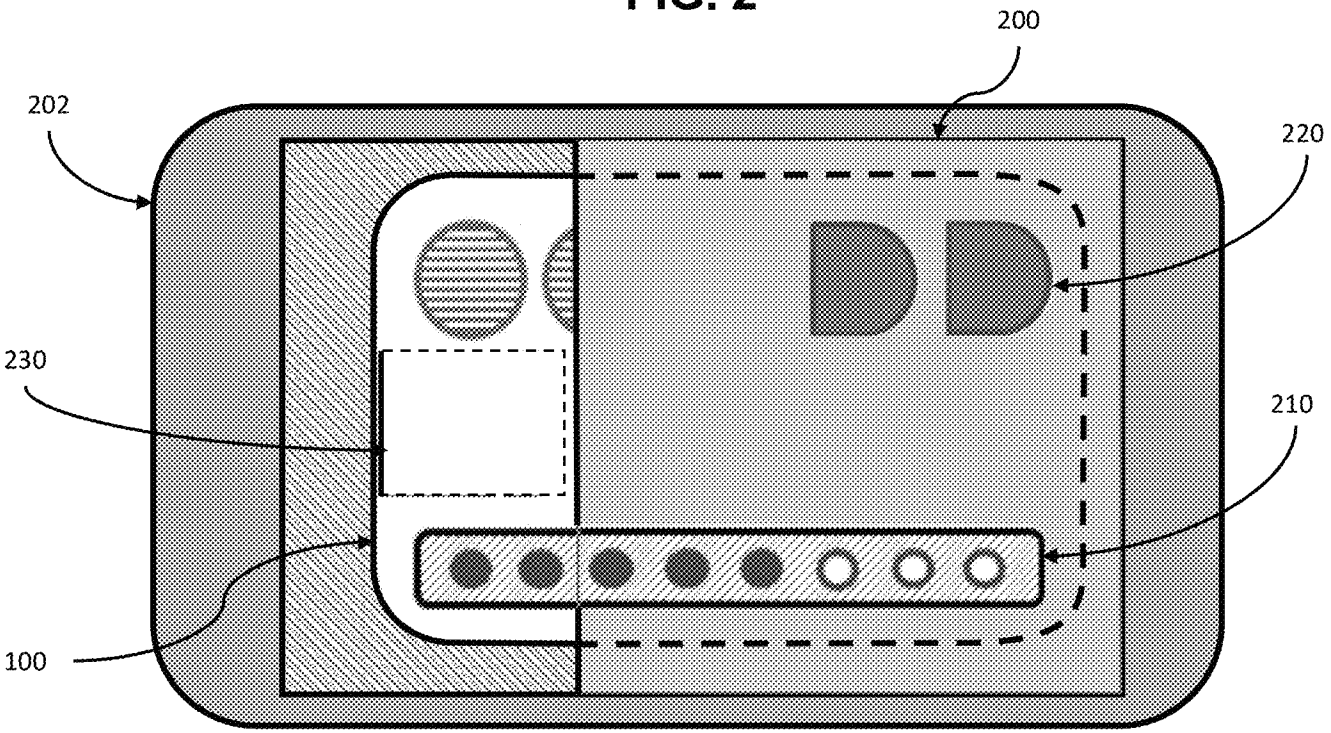
FIG. 2 depicts the ICC incorporated into a protective sleeve with apertures for integrated sensors and data transmission modules, as incorporated into a smartphone chassis.

As shown in FIG. 2, during use the ICC 100 may optionally be housed in a protective cover 200 that has apertures 210 that provide environmental access for the sensors, and optionally apertures 220 for wireless data transmission elements to communicate. The onboard storage 230 is depicted as being integrated into the ICC, although removable storage is also contemplated as an alternative or in addition to the onboard storage. The ICC cover 200 may optionally include a hard-wired connection that accesses data from the ICC (not shown) to provide to a user interface. In some aspects of the invention, the ICC protective cover 200 may be incorporated into a smartphone chassis 202, and interface with a smartphone as the host platform. Incorporating the ICC into a smartphone may provide more battery power and data processing capability than can be housed within the ICC 100 and/or its protective cover 200.

Figure 3:
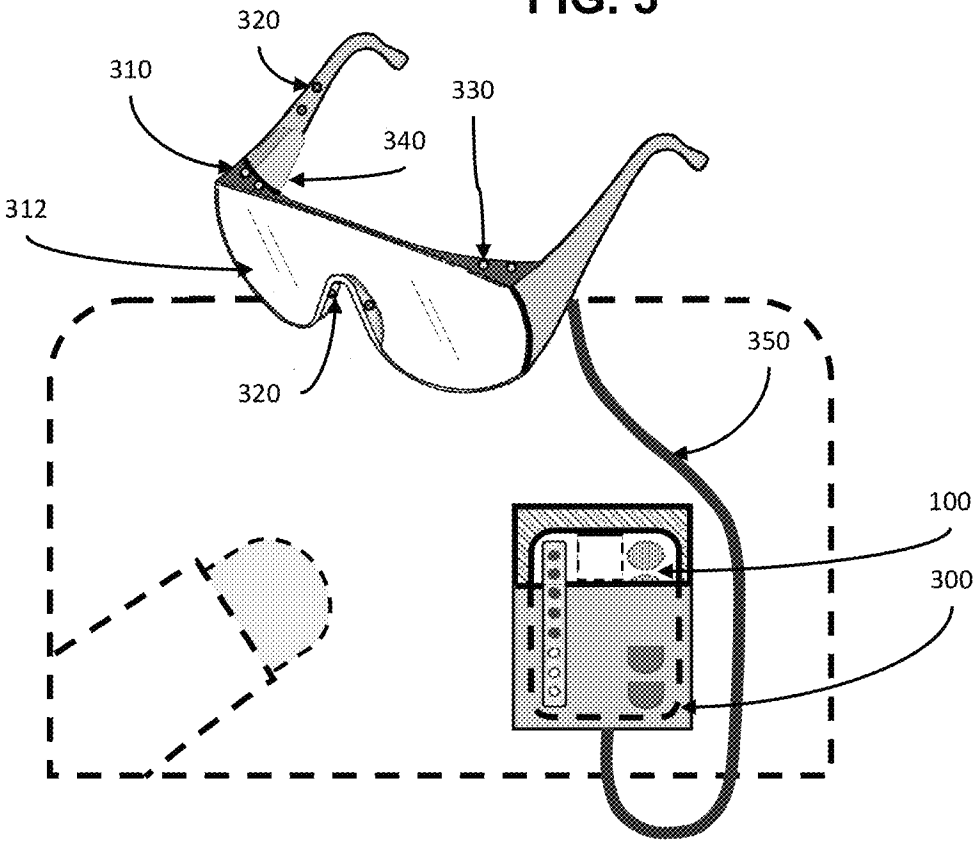
FIG. 3 depicts the ICC incorporated into a protective sleeve worn on clothing, with a wired connection to a user interface in the form of safety glasses.
Figure 4:
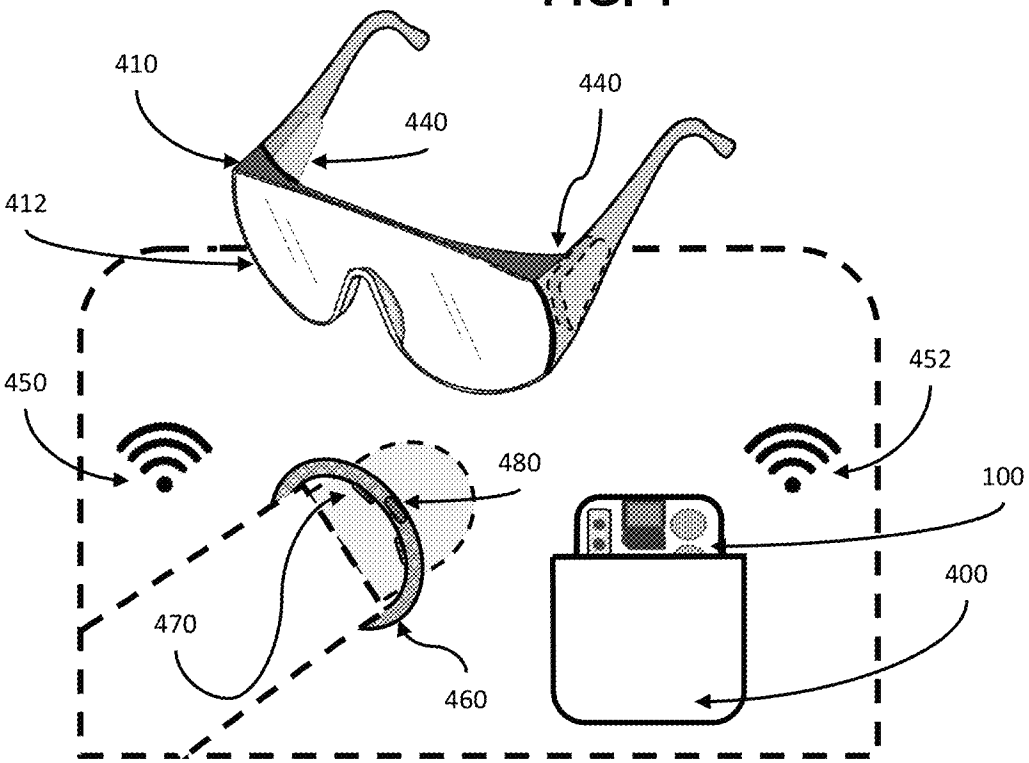
FIG. 4 depicts the ICC provided in a clothing pocket, with wireless connections to additional wearable sensors and a user interface in the form of safety glasses.
Figure 5:
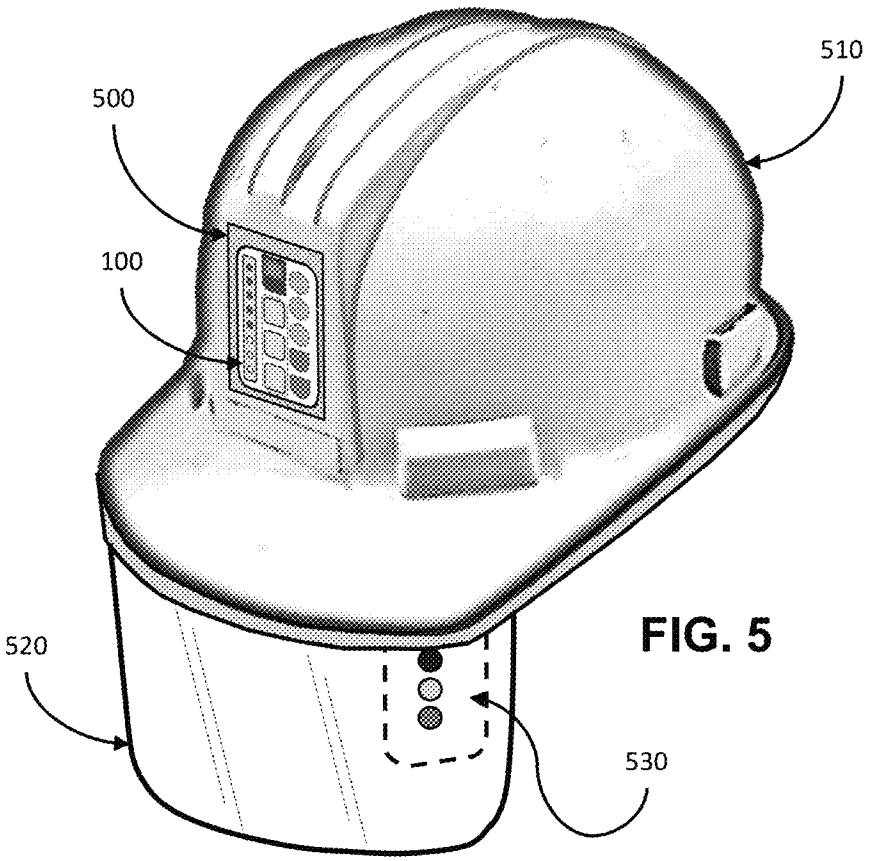
FIG. 5 depicts the ICC incorporated directly onto a user interface in the form of a hard hat having additional sensors provided therein, and a visor display.

As shown in FIGS. 3-5, the ICC 100, with or without its protective cover, may be incorporated into a worker's clothing or safety gear. The ICC 100 is preferably provided with a user interface 310, 410, 510.

FIG. 3 shows an ICC 100 provided in a protective cover 300 that is affixed directly to clothing using a backing that may include, for example, clips, snaps, or Velcro as an attachment. The ICC is issued to the worker along with safety glasses 310 that also serve as a visual display system (VDS). The safety glasses 310 have a viewing surface 312 that also protects the worker from eye hazards. Personal health sensors 320 may be incorporated into the safety glasses 310 in an area that contacts the worker's skin, such as around the nosepiece and/or along the earpieces. In some optional embodiments, physical environmental sensors 330 may also be included in the safety glasses 310 to monitor the conditions surrounding the worker. A projector 340 may be incorporated into the frame of the safety glasses 310, and project environmental and/or health information and warning onto the viewing surface 312. The ICC 100 has a wired connection 350 that connects to the VDS 310. This may be preferred when the worker is carrying out tasks in an environment where interference may impact wireless transmission of information.

FIG. 4 shows another embodiment of the invention, in which an ICC 100 is inserted into a pocket 400, as may be incorporated into clothing. The ICC 100 is issued to the worker along with safety glasses 410 that provide the VDS. The safety glasses 410 have a viewing surface 412 that also protects the worker from eye hazards. Projectors 440 are incorporated into the frame of the safety glasses 410, and project environmental and/or health information, alerts, and warning onto the viewing surface 412. No sensors are incorporated into the safety glasses 410, but the worker is provided with a wristband or fitness tracker 460 having sensors 470 that provide information regarding personal vital statistics to the ICC 100 using a wireless connection 450. The ICC 100 receives the information regarding personal vital statistics from the wristband sensors 470, and the onboard processor (not shown) combines this data with information from the environmental sensors provided on the ICC, and uses a wireless connection 452, to transmit environmental and health information, alerts, and/or warnings to the VDS. The VDS uses the projectors 440 to display the information to a worker on all or a portion of the viewing surface 412.

Presently-preferred aspects of the invention provide apparatus that include one or more ICCs and a head-mounted VDS. The apparatus of the invention beneficially provide communication between individual subsystems (i.e., the ICC and VDS, and any remotely-located processors, sensors, or alert apparatus), either via a wire tether (as shown in FIG. 3) or a wireless interface (as shown in FIG. 4). The wire tether may be preferred in some settings where interference or poor signal transmission may be issues. Wireless communications may be preferable when freedom of movement is a concern, and may be provided via Bluetooth, radio or other wireless signals, wireless sensor network (WSN) technology, or any other link capable of transmitting data from a sensor to a processor without impeding ability to work.

FIG. 5 depicts yet another embodiment of the invention, in which ICC 100 is affixed to a hardhat 510. ICC 100 is affixed directly to the outer surface of hardhat 510 using a backing that includes clips, snaps, or Velcro as an attachment 500. The hardhat 510 includes a safety visor 520 that provides the VDS, which may include a display area 530 for environmental and health information and warnings. The exterior surface of the hardhat preferably is not penetrated by any sensors (maintaining its ability to provide head protection), and has a minimum of items affixed thereto. In some aspects of the invention, only the ICC 100 is affixed to the outer surface of hardhat 510. In other aspects, the ICC 100 is provided separately from the hardhat 510 and uses a wireless or wired connection to transmit data and warnings to the visor 520 that serves as the VDS, to avoid compromising head protection.

As depicted in FIG. 5, in some aspects of the invention, the apparatus of the invention encompass self-contained systems in which some or all of the subsystems (including sensing, processing, and communicating components) are incorporated into a single article of protective headgear or eyewear. In these aspects of the invention, the sensing, processing and communicating components may not be provided on a separate ICC subsystem, but instead may be individually incorporated into the protective headgear or eyewear. In other aspects of the invention, all-in-one systems are not preferred because of the costs associated with configuring the specialized safety apparatus.

Figure 6:
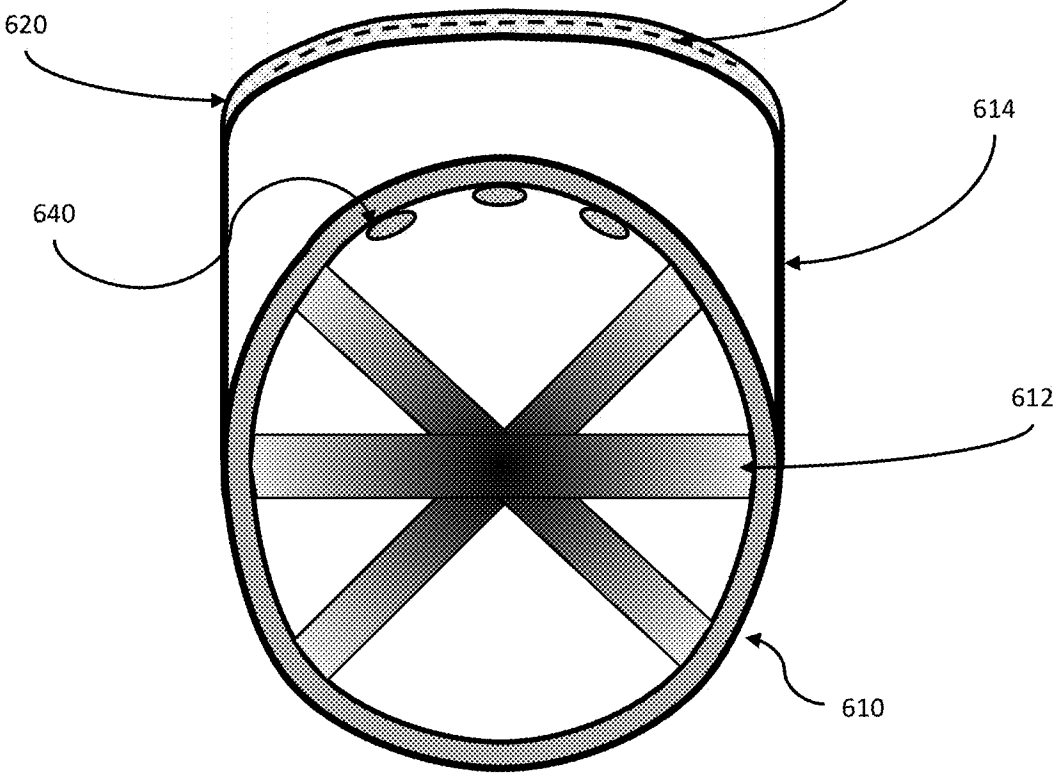
FIG. 6 is a bottom view of the hard hat shown in FIG. 5, depicting the additional sensors and the visor display.

FIG. 6 shows the inside view 610 of the hardhat of FIG. 5. The hardhat interior 610 includes adjustable bands and/or straps 612 to secure the hardhat to the worker's head. The safety visor 620 is provided around the brim 614 of the hardhat, and the safety visor 620 preferably incorporates a display area 630. The display area 630 may be an LCD display panel that encompasses either the entire surface of the safety visor 620 or a portion thereof, providing the worker with environmental and personal health information and warnings that are superimposed on the worker's field of vision. Personal health sensors 640 may be provided on the surface of the adjustable bands and/or straps 612 in positions that contact the wearer's skin. Wired or wireless connections may be used to receive data from the sensors and send data to the LCD panel to be displayed.

Figure 7:
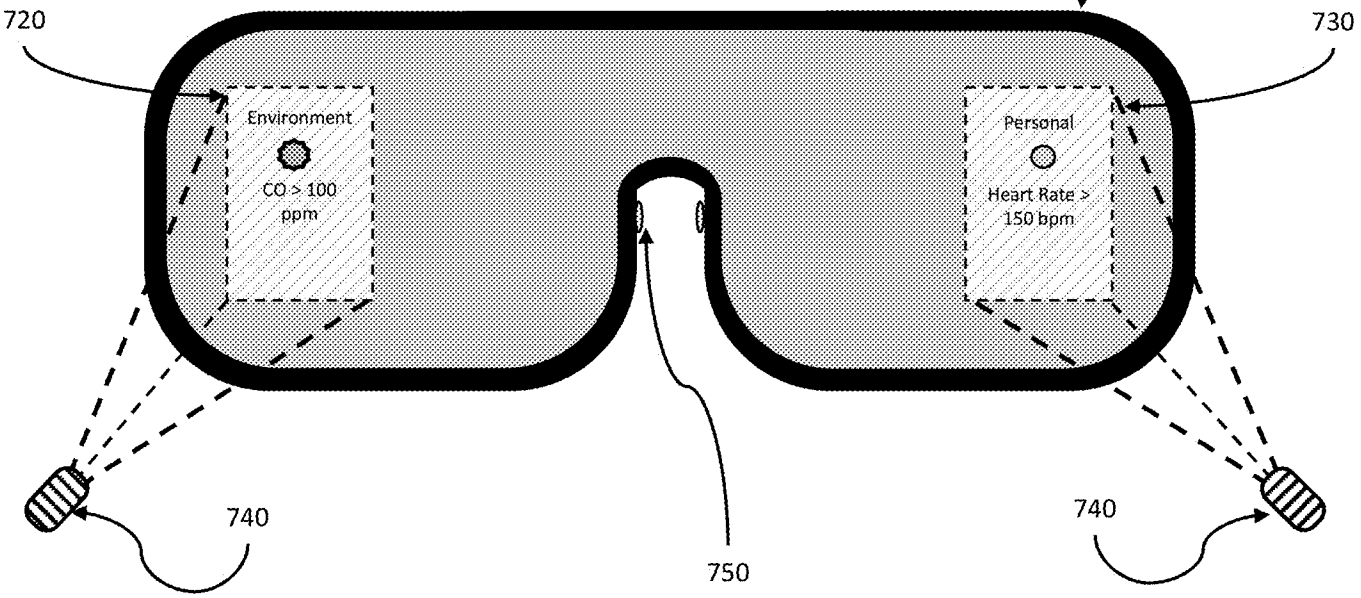
FIG. 7 depicts a display of safety information from the perspective of a worker wearing the safety glasses of FIGS. 3-4.

FIG. 7 shows an exemplary display in which safety glasses 710 have a viewing surface 720 for displaying environmental information and warnings, and a viewing surface 730 for displaying personal health information and warnings. Projectors 740 may be provided to project the information being displayed, though in other aspects of the invention, the viewing surface may be provided by one or more LCD panels incorporated into the safety glasses or visor. Personal health sensors 750 may be provided on the nosepiece of the safety glasses.

Various PPE items such as safety glasses, visors, hardhats, and other wearables may be configured to serve as the user interfaces of the invention, or the user interfaces may be separate from the safety gear. In some aspects of the invention, the user interface is integrated into existing OSHA-approved protective eyewear. Regardless of configuration, the user interfaces of the invention receive warnings and provide them to workers in a manner that may vary depending on the urgency of the warning. In some aspects of the invention, the user interface is a smartphone or tablet carried by the worker that is configured to display safety information based on data received from the environmental and health hazard sensors. In further alternatives where the worker's visual attention must remain focused on the tasks being carried out, safety information updates can be provided by a wearable device such as a smart watch, fitness tracker, or wrist/arm/headband. The safety information updates may be conveyed by vibration, or an audible alert or alarm. Buzzers and speakers may be incorporated into the wearables to provide these non-visual alerts, or vibrating motors and speakers in a smartphone may be used to communicate with the worker in addition to providing visual displays.

In some aspects of the invention, the user interface is a visual display system (VDS) that receives information, provides status updates, displays warnings, and receives user inputs in response to the notifications and alerts. Exemplary VDS for use with the apparatus of the invention may include, but are not limited to, augmented reality systems such as Google Glass™ (Google Inc., Mountain View, Calif.), as described, for example, in U.S. Pat. Nos. 8,558,759; 8,611,015; 8,750,541; 9,195,067; 10,638,114; 10,721,589, and the Microsoft HoloLens® (Microsoft Corporation, Redmond, Wash.), as described, for example, in U.S. Pat. Nos. 9,116,666; 9,495,801; 9,508,195; 9,759,913; 9,759,917. These patents are incorporated herein by reference in their entirety.

The smartphones, wearable items, and user interfaces of the invention may be configured to provide data to the processors incorporated into the apparatus of the invention, such as by wireless transmission of data. These smartphones, wearable items, and user interfaces may also be configured to accept input from the user to be transmitted to the processors incorporated into the apparatus of the invention, such as acknowledging and/or clearing safety alerts and warnings, or requesting emergency assistance. This may be accomplished, for example, by pushing a button provided on a wearable band or visual display system, or interacting with a touch sensitive surface of a smart watch or smartphone.

The user interfaces of the invention preferably incorporate biometric sensors, and may also incorporate basic physical environment sensors (ambient temperature, humidity, light). This allows the biometric sensors to be provided in close contact with the worker, permitting more accurate measurements. Biometric sensors may also be provided on other optional wearable items in close contact with the worker. These wearable items may include, but are not limited to, safety glasses, hardhats, smart watches, wristbands, fitness trackers, belts, head bands, arm bands, and protective clothing panel inserts. In some aspects of the invention, the user interface includes multiple articles, configured to work together to provide information from a variety of sensors, and convey a variety of types of alerts, such as a combination of smartphone, wristband, and safety glasses providing visual, auditory, and tactile alerts.

The biometric sensors provided in the various user interfaces of the invention may measure data relating to the health of the individual, including, but not limited to, body temperature, blood pressure, blood oxygen level, heart rate, and respiration rate. For example, body temperature, pulse rate, respiration rate, and blood pressure data can be used to assess the ability of the wearer to safely remain in a given environment for another 10 minutes, 20 minutes, 30 minutes, 1 hour, 2 hours, 3 hours, 4 hours, or more, even if no hazards are detected by the environmental sensors. This may be particularly useful for workers assigned to perform tasks in enclosed or confined spaces. Additional biometric sensors may include perspiration sensors, lactic acid level sensors, and sensors to detect the presence of toxic or infectious agents in the wearers' perspiration, saliva, and breath. The biometric sensors can be used to alert the worker to personal health hazards affecting ability to work in a given environment, even if no hazardous substances are detected.

The processors of the invention may be configured to use personal health information to adjust safety thresholds for environmental and health hazards for an individual worker, such as personal health information stored on a memory module used in the apparatus of the invention. For example, radiological sensor data may be provided with additional weight for an individual worker who provides personal health information that identifies a lifetime cumulative exposure amount that is approaching a safety threshold, such as a lifetime exposure limit. Sensor data regarding toxic mold exposure may be provided with additional weight for an individual worker who has an identified mold allergy. Sensor data regarding presence of chemicals in the environment may need to be provided with additional weight for an individual worker who has lung damage identified in personal health information.

In some aspects of the invention, the processor is provided as part of the ICC. In other aspects, the processor may be incorporated into the user interface, such as the VDS. In still further aspects, the processor may be in communication with the sensors, but located remote from the user. Regardless of its location, the processor may implement programming that is provided by software stored in on-board memory, as is described in greater detail with respect to the systems and methods of the invention. The processor may also access removable data storage. This separate, removable data storage is preferably used to store data relating to the health of the individual, and may store customized hazard threshold information unique to the individual. In some aspects of the invention, individual workers are issued their own removable storage media, and health data is collected, processed, and stored on the removable storage media separate from other data collected by the apparatus, thereby allowing workers to maintain control over their health data.

The apparatus of the invention may safeguard a worker's personal health information by segregating the collection, processing and storage of all biometric data and health information. It preferably adheres to all applicable HIPPA privacy and security rules for Protected Health Information (PHI) and electronic Protected Health Information (ePHI). The apparatus can compare real-time biomedical data against a worker's stored personal health profile. This comparison can result in alerts to help the worker determine if their current physical condition exceeds personal boundaries or limits prescribed by trained medical personnel.

The apparatus of the invention provides a naval industrial worker, Sailor or Marine with real-time information on-demand regarding their worksite environmental conditions and biomedical status. This information enables a worker to have enhanced situational awareness, avoid or mitigate exposure to workplace hazards and make better personal safety and productivity decisions. Naval industrial workers, Sailors and Marines are often required to work in enclosed or confined spaces. These spaces can be extremely hazardous as they tend to be remotely located, dimly lit, poorly ventilated, and contaminated with a combination of biological, chemical or radiological agents. Providing workers with an in situ capability to assess their own health conditions and work environment in real-time enables them to make more informed decisions regarding their personal safety. The apparatus of the invention helps shipyard workers in particular, as they must continuously monitor workplace hazards and avoid, or mitigate, any changes in worksite conditions that may cause an accident that could result in injury, illness, or death. This capability lessens worker dependency on industrial hygiene and safety inspection personnel. The effect will allow workers to use their time more effectively and productively by reducing the need for re-inspection of spaces over the course of any given work shift.

Systems and Methods.

The systems and methods of the invention are described in more detail with respect to the flow charts shown in FIGS. 8A-8D, which depict one exemplary embodiment of the steps that may be used to implement the methods of the invention.

The flow charts illustrate elements that may be incorporated into software that is implemented by processors incorporated into the apparatus of the invention. Processors are provided on one or both of the ICCs and user interfaces of the apparatus of the invention, and are configured to compare data from a variety of sensors against multiple levels of safety thresholds that may be customized for the working conditions where the sensors and user interface are being used, and based on the personal health of the worker using the apparatus. The safety threshold levels may be drawn, for example, from existing OSHA and/or NIOSH guidelines regarding immediate and cumulative risk thresholds for applicable hazards.

The processors collect real-time situational awareness, work environment and biomedical data and process the data into usable safety information. The safety information may take a variety of forms, including, but not limited to, alerts indicating a hazard exceeds a safety threshold, warnings indicating that a hazard is approaching a level of concern with respect to a safety threshold, and status information based on current readings from one or more sensors.

The processors transmit the safety information to one or more user interfaces. The user interface preferably provides a basic suite of sense-and-display standalone capabilities that allow it to be standardized and mass produced. It provides the most basic level of situational awareness capability for the least cost. It can host a standard suite of biomedical sensors and sensors that provide basic ambient environmental information, i.e., air temperature, relative humidity, heat index, ambient light and radiated noise levels. Additional sense-and-display capability may be added by tethering (either by wired or wireless connection) the user interface to an ICC having multiple environmental sensors, and one or more embedded processors and/or controllers. When tethered, the user interface, which may include more than one interface, such as safety glasses/visor, smartphone, or other displays, preferably provides all of the visually displayed safety and health information generated by the processor or processors.

The user interface displays information-based instructions, warnings, and/or alerts transmitted by the processor, which are based on the comparison of sensor data with acceptable hazard limits and safety thresholds. The user interface may be designed with features for receiving user input in response to the sensor data, and transmitting that user input back to the processor. The user interface may also provide visual, audible, and/or tactile cues to the wearer, in order to notify and alert the wearer of significant changes in work environment, real-time hazardous exposure limits, cumulative time-based hazardous exposure limits, as well as the operating status of the apparatus (i.e., low battery, loss of wireless signal).

The software instructions used to configure the systems of the invention may be stored in a memory module and executed remotely by a processor in a computer that is in communication with the apparatus used in the systems and methods of the invention. The software may also be stored in a computer-readable memory provided onboard the apparatus of the invention, preferably in the ICC, and executed locally by a processor provided in the apparatus. Those skilled in the art will recognize that the methods of the invention may be implemented using various computer systems and/or architectures, and the methods of the invention are not limited to any particular configuration.

References to processors or microprocessors herein may include processors or microprocessors that are incorporated into controllers or microcontrollers. These controllers or microcontrollers may incorporate the processor or microprocessor along with additional components such as RAM, ROM, and programming that renders the microcontroller or controller a special-purpose machine customized for use in the systems of the invention and for carrying out the methods of the invention.

The methods of the invention encompass steps for configuring the environmental hazards associated with the work to be completed; configuring the personal health hazards associated with the worker assigned to complete the work; monitoring data received from sensors detecting environmental and worker health information; comparing immediate and cumulative sensor data against safety thresholds; and providing safety status information to workers, supervisors, and/or safety staff, including alerts or warnings when applicable safety thresholds are exceeded.

In some aspects of the invention, methods for issuing workplace hazard alerts to a worker are provided. The methods include providing sensors to monitor one or more environmental hazards associated with the workplace; and providing sensors to monitor one or more health hazards associated with the worker assigned to the workplace. The processors receive data from environmental hazard sensors and health hazard sensors, and compare the data from the environmental hazard sensors and health hazard sensors with safety thresholds for each hazard. Based on this comparison, which determines whether an alert level or a safety threshold is exceeded, the processor directs communication of an alert indicating that an alert level or a safety threshold for an environmental hazard or health hazard has been exceeded. The alert may be a visual alert communicated by a visual display system, or an auditory and/or tactile alert communicated by a user interface.

OSHA and NIOSH have not established thresholds for workers exposed to combinations of hazards. When workers are faced with a combination of hazards, even if none exceed existing safety limits, the aggregated data received from the sensors regarding environmental and/or health hazards can result in an overall unsafe condition. In view of these limitations in existing environmental hazard detection systems, the processors provided in the systems of the invention can be configured to issue an alert based on the detection of two or more low-level hazards, even when no individual sensor detects a condition that exceeds acceptable safety limits. For example, if position/location sensors detect that a worker is in an area known to be difficult to access or ventilate, if a personal temperature sensor detects that the worker is in danger of overheating, this may trigger an alert. The same personal temperature sensor data may not result in an alert for a worker in an area that is accessible and/or well-ventilated.

Accordingly, the methods of the invention optionally include carrying out further processing of sensor data that does not exceed any safety thresholds. This further processing may include aggregating the data from environmental hazard sensors and health hazard sensors that does not exceed safety thresholds. The aggregated data may be compared against one or more aggregated risk profiles. If the processor determines that an aggregated risk profile is exceeded, the processor directs communication of this safety information. The safety information may be conveyed as an alert.

The aggregated risk profiles may be made up of levels of combinations of two or more of the environmental hazards and health hazards being monitored by the systems and apparatus of the invention.

The number and type of low-level hazards that may result in triggering an aggregated sensor data alert or warning may vary based on the particular work situation. For example, systems, methods, and software of the invention may be configured such that workers in confined and/or remote spaces, or working at height, are issued a warning to stop work as soon as any potential hazard is identified as being within 25%, 50%, or 75% of a safety threshold, due to the inherent dangers of these workspaces even under ideal environmental conditions. As another example, a worker with may receive an aggregated hazard safety alert when working in an environment where elevated levels of carbon dioxide, low levels of oxygen, and other air quality issues are present simultaneously, even if they do not individually trigger any alerts or exceed any safety thresholds.

Heightened personal health risks may also be considered when issuing aggregated sensor alerts, depending on the specific nature of the hazards. The systems, methods, and software of the invention may be configured such that workers are not permitted to clear alerts related to their identified personal health risks. A worker with known heart disease cannot clear an alert and continue working once an elevated heart rate has been detected. The same worker may be able to acknowledge and clear alerts issued by the system and continue working when environmental hazards unrelated to their personal health risks are detected, such as high levels of noise or elevated temperatures.

The systems, methods, and software of the invention may be configured such that workers with minimal personal health risks working in lower-risk environments may be able to clear warnings and keep working in the presence of up to 3-4 identified low-level hazards, particularly where the workers are equipped with safety gear designed to minimize risks associated with the hazards.

In some aspects of the invention, information regarding use of such personal protective equipment may also be provided as a factor in the algorithm used in the systems, methods, and software for generating alerts. For example, a worker having a ventilator or supplemental oxygen may be able to continue working when environmental sensors detect poor air quality. If the worker is provided with an ICC specific to the task or setting, it is preferably programmed with alerts and safety thresholds that incorporate information regarding PPE used in association with the task or setting to avoid issuing distracting, unnecessary alerts.

In some aspects of the invention, the systems, methods, and software of the invention are configured to allow the apparatus of the invention to be operated in high risk or low risk environmental modes, indicating the tolerance for presence of multiple risk factors. An additional high and low risk personal health mode may be provided, which may be activated when a user inserts a memory module containing personal health information that indicates heightened risks to categories of hazards, or activates a switch to enter into a high risk mode. These modes may be selected by the workers using the user inputs provided in the apparatus of the invention, but in some aspects of the invention the apparatus of the invention are configured to operate in high or low risk modes before the apparatus is assigned to an individual worker at the start of a shift, to avoid inadvertent activation of an inappropriate risk mode.

The systems, methods, and software of the invention are configured to communicate information to the worker using one or more visual, audio and tactile cues. Alerts and warnings may be issued when worksite conditions approach, or exceed, established safety limits or thresholds, or lower limits or thresholds set for the workplace. Workers employed in the following occupations will find the systems and methods of the invention particularly well suited for use in hazardous work environments, confined spaces and isolated worksites: heavy manufacturing; plant/factory engineering; mechanical system maintenance and repair; biomedical; and chemical field services.

In some presently-preferred aspects of the invention, alert levels may be set by the U.S. Navy Safety Center (NSC), in conjunction with the Navy Bureau of Medicine (BUMED) based on testing of expected gas mixtures and working conditions in consultation with sensor manufacturers, safety experts, and medical officers. Alert levels may also be tailored for individual workers based on age and personal health history.

A non-limiting method for using the systems, methods, and software of the invention is described below with reference to the flow charts provided in FIGS. 8A-8D.

Figure 8A:
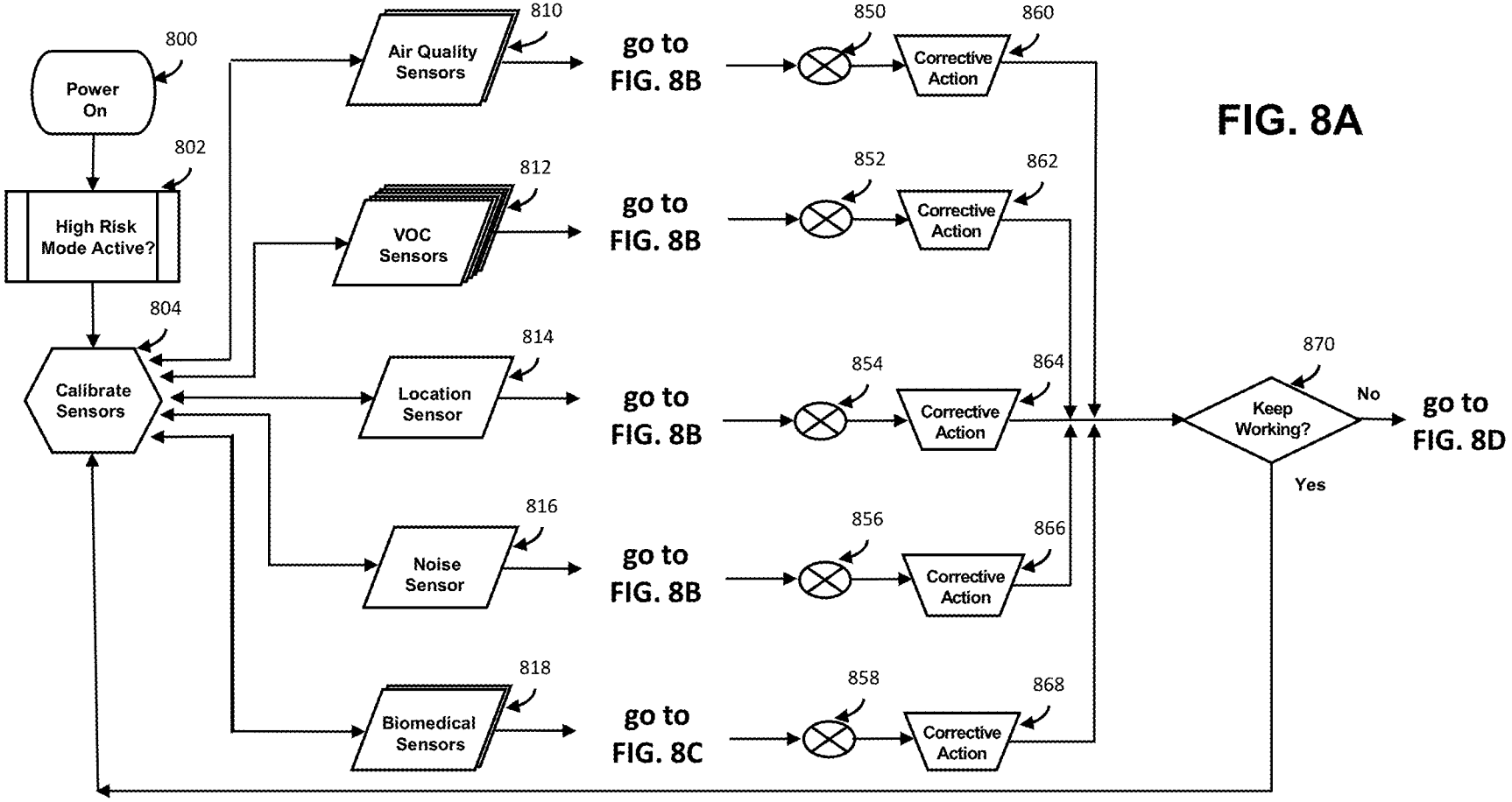
FIG. 8A-8D are flow charts for processing information obtained using the ICC and any additional sensors, including displaying safety information via the user interface.

As shown in FIG. 8A, when ready for use, the apparatus is powered on 800, optionally performing a check to determine if a high risk setting has been activated 802. The sensors are optionally calibrated 804 (e.g., when self-calibrating sensors are not used).

The sensors in the apparatus are used to provide data from a selection of sensors, and may include air quality sensors and associated data 810, volatile organic compound sensors and associated data 812, GPS/geolocation sensors and associated data 814, airborne noise sensors and associated data 816, and biomedical sensors and associated data 818. The sensors may engage in continuous signal processing and sampling rate adjustment. Sensor readings and rate of change determinations are taken from each sensor at predetermined intervals that may be configured by a user, or pre-programmed (e.g., about 5 minutes, about 10 minutes, about 15 minutes, about 30 minutes, about 1 hour). The intervals may vary based on the relative risk associated with the environment where the sensors are used, such that the interval between sensor readings is lower when the risk level is higher.

Figure 8B:
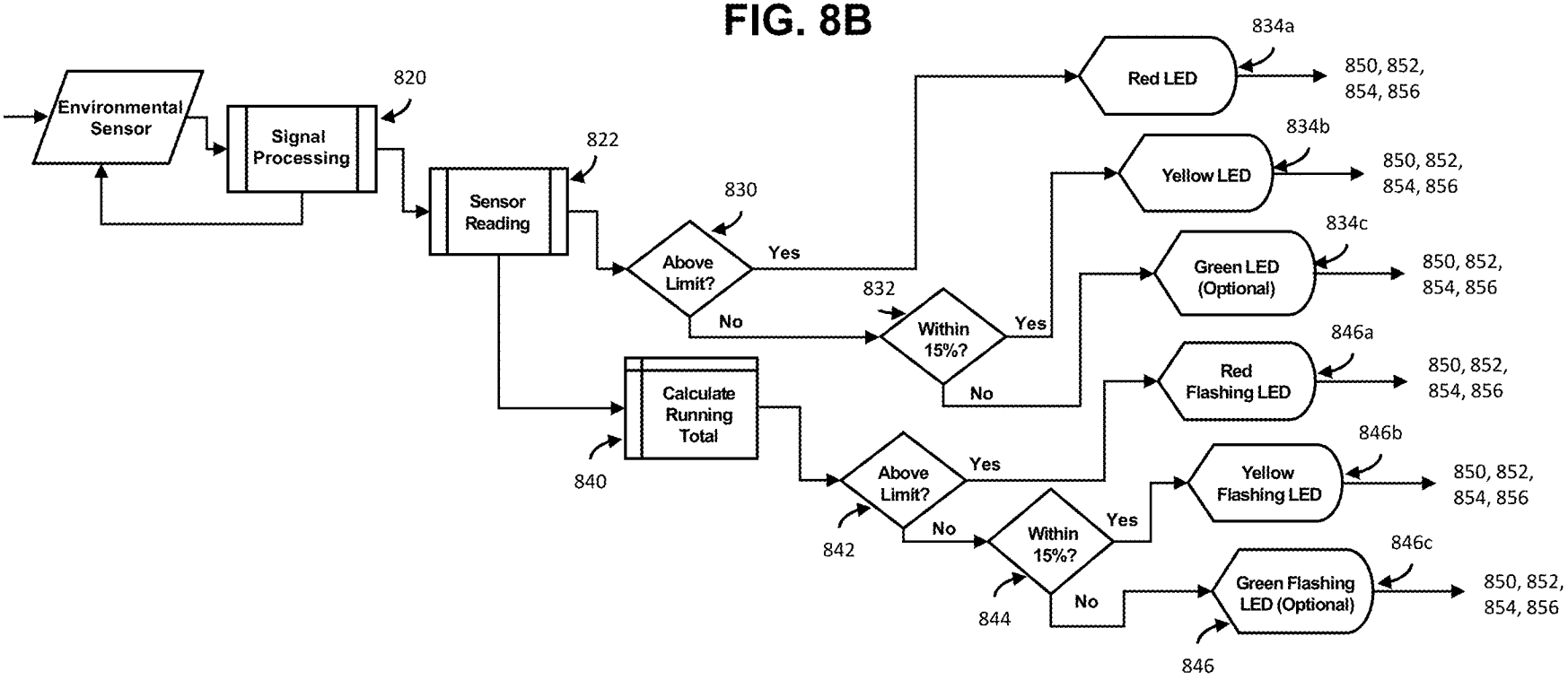

The data from the sensors in 810, 812, 814, and 816 are processed in accordance with the flow chart provided in FIG. 8B. The data from the biometric data sensors in 818 are processed in accordance with the flow chart provided in FIG. 8C.

In FIG. 8B, air quality hazard sensors and associated data 810, volatile organic compound hazard sensors and associated data 812, GPS/geolocation sensors and associated data 814, and airborne noise hazard sensors and associated data 816 are processed as "environmental sensor" data. The data from the sensors is processed 820, and in an optional iterative process the sampling rate for obtaining data may be adjusted.

The sensor data is read 822, and a determination is made as to whether the sensor data shows that a particular hazard is above an applicable threshold or limit 830. If the hazard is above the limit (which may be based, for example, on OSHA or NIOSH-established safety thresholds, or may be set by another entity), then the processor instructs the user interface to issue a warning to the worker 834*a*, which may be a solid red LED, although the invention is not limited to a particular type of visual warning display. Audible alerts, vibration alerts, and/or text based alerts may be provided in addition to the red LED alert, or as an alternative. The process then returns to step 850, 852, 854, or 856 of FIG. 8A, depending on the type of sensor data (i.e., air quality, VOC, GPS/geolocation, airborne noise).

In some aspects of the invention, the worker may be able to clear some red alerts, such as for loud noises, and may not be able to clear other red alerts, such as for radiological hazards. Some red alerts may be able to be cleared repeatedly, such as for loud noises, but other red alerts may only be cleared a preset number of times (e.g., 2, 3, 4, or 5 times), such as for excessive levels of VOCs. These permissions may be granted to workers in the programming executed by the processor in the ICC, and are preferably based on OSHA or NIOSH standards, or workplace safety management.

If a hazard is not above the threshold or limit 830, then a separate step of determining whether the hazard is approaching a level of concern with respect to the hazard limit may be carried out 832. The cutoff for determining whether the sensor data is too close to an established limit may vary depending on the workplace, or the nature of the hazard. If the sensor data indicates that the hazard is within the level of concern (e.g., it is within 50% of the limit, 40% of the limit, 30% of the limit, 20% of the limit, 15% of the limit, 10% of the limit, or another level of concern that has been established), then the processor instructs the user interface to issue a warning to the worker 834*b*, which may be a solid yellow LED, although the invention is not limited to a particular type of visual warning display. Audible alerts, vibration alerts, and text based alerts may be provided in addition to the yellow LED alert, or as an alternative. The process then returns to step 850, 852, 854, or 856 of FIG. 8A, depending on the type of sensor data (i.e., air quality, VOC, GPS/geolocation, airborne noise).

In some aspects of the invention, the worker is able to clear all yellow alerts, and may be able to do so repeatedly. Some yellow alerts may only be cleared a set number of times, such as for excessive levels of VOCs that do not exceed a maximum allowable limit. In other aspects of the invention, where multiple yellow alerts are being issued simultaneously, the ability to clear the alerts may be denied, or the alert level issued may be elevated to a red LED alert that cannot be cleared. These permissions may be granted to workers in the programming executed by the processor in the ICC, and are preferably based on OSHA or NIOSH standards, or workplace safety management.

If the hazard does not exceed a safety threshold or upper limit, and is not within a level of concern, then the processor may optionally instruct the user interface to display a green LED to the worker 834*c*, to provide visual confirmation that the environment does not present any hazards. In other aspects of the invention, no display may be provided, in order to avoid visually overloading the worker and potentially creating a distraction when there is no safety information requiring the worker's attention. In some optional aspects of the invention, the sensor data regarding the hazard may be further processed.

The rate of change in the sensor data may also be determined to assess whether readings from a particular sensor are trending up or down, the length of time that a particular environmental hazard has been elevated, or to calculate a running total 840 where cumulative exposure to a hazard may be a factor in making a safety determination.

When rates of change in data received from sensors are monitored, this information may be used, for example, to calculate a time interval when each environmental hazard and health hazard is predicted to exceed any applicable limits or safety thresholds, or exceed a level of concern. Once calculated, the systems and methods of the invention may be used to communicate safety information indicating how much time the worker may have before the applicable limits or safety thresholds are predicted to be exceeded.

The invention also permits maintaining a running total of data received from each different sensor over time. Even when sensor readings do not indicate that an immediate exposure limit or safety threshold is exceeded for the detected hazards, calculating a cumulative exposure for the environmental hazards and health hazards over a period of time can provide additional safety information.

Where a cumulative exposure total 840 is calculated, a determination is made as to whether the sensor data shows that the cumulative level of a particular hazard is above an applicable threshold or limit 842. If the cumulative hazard is above the limit (which may be based, for example, on OSHA or NIOSH-established safety thresholds, or may be set by another entity), then the processor instructs the user interface to issue a warning to the worker 846*a*, which may be a flashing red LED, although the invention is not limited to a particular type of visual warning display. Audible alerts, vibration alerts, and/or text based alerts may be provided in addition to the flashing red LED alert, or as an alternative. The process then returns to step 850, 852, 854, or 856 of FIG. 8A, depending on the type of sensor data (i.e., air quality, VOC, GPS/geolocation, airborne noise).

In some aspects of the invention, the ability of a worker to clear the flashing red LED alerts may be limited, because it represents prolonged exposure to a hazard above acceptable limits. Any permissions to clear cumulative exposure warnings may be granted to workers in the programming executed by the processor, and are preferably based on OSHA or NIOSH standards, or workplace safety management.

If a cumulative hazard is not above the threshold, then a separate step of determining whether the cumulative hazard is approaching a level of concern with respect to the cumulative hazard limit may be carried out 844. The cutoff for determining whether the sensor data is too close to an established cumulative limit may vary depending on the workplace, or the nature of the hazard. If the sensor data indicates that the cumulative hazard exposure is within the level of concern (e.g., it is within 50% of the limit, 40% of the limit, 30% of the limit, 20% of the limit, 15% of the limit, 10% of the limit, or another level of concern that has been established), then the processor instructs the user interface to issue a warning to the worker 846*b*, which may be a flashing yellow LED, although the invention is not limited to a particular type of visual warning display. Audible alerts, vibration alerts, and/or text based alerts may be provided in addition to the flashing yellow LED alert, or as an alternative. The process then returns to step 850, 852, 854, or 856 of FIG. 8A, depending on the type of sensor data (i.e., air quality, VOC, GPS/geolocation, airborne noise).

In some aspects of the invention, the worker may only be able to clear certain flashing yellow LED alerts, and only a fixed number of times, which may vary based on the type of cumulative hazard and/or the rate at which the hazard is changing. These permissions may be granted to workers in the programming executed by the processor, and are preferably based on OSHA or NIOSH standards, or workplace safety management.

If the cumulative hazard does not exceed a limit, and is not within a level of concern, then the processor may optionally instruct the user interface to display a flashing green LED to the worker 846*c*, to provide visual confirmation that the environment does not present any hazards. In other aspects of the invention, no display may be provided, in order to avoid visually overloading the worker and potentially creating a distraction when there is no safety information requiring the worker's attention.

Figure 8C:
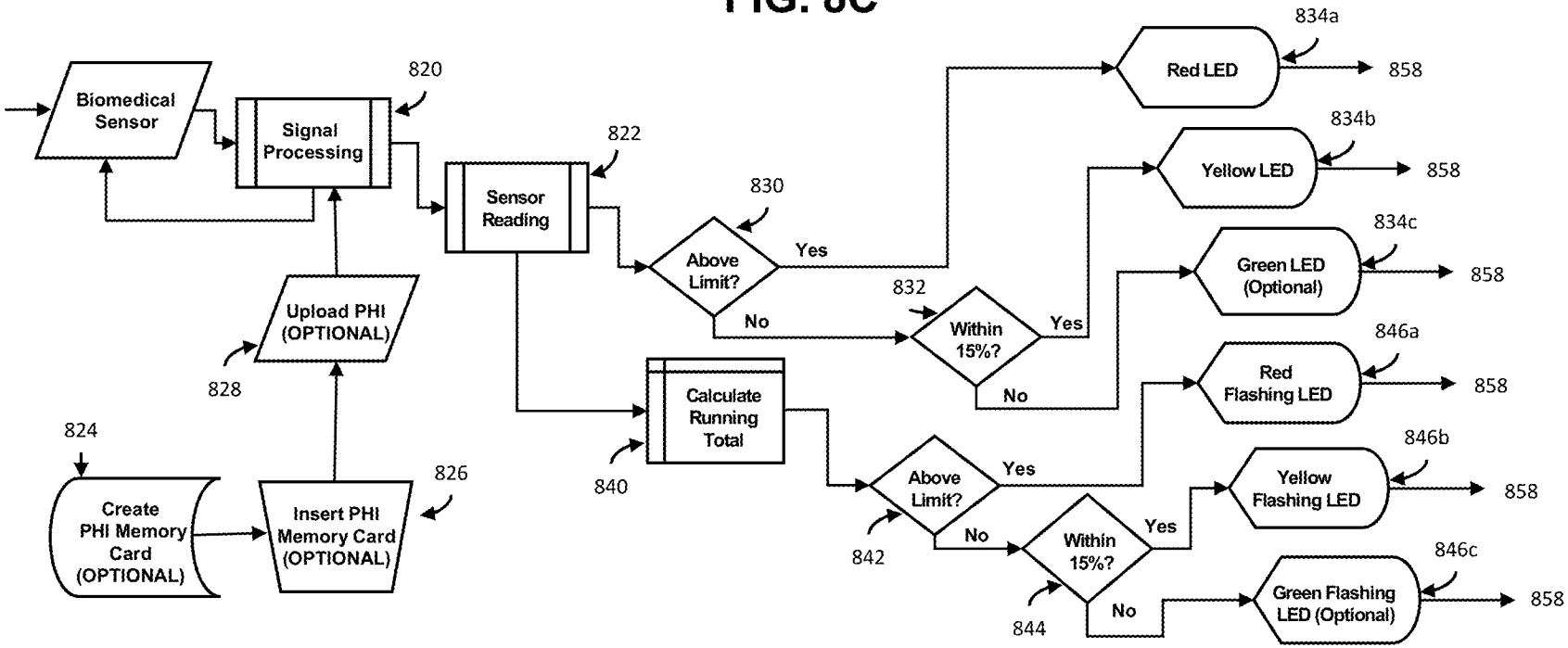

In FIG. 8C, biomedical hazard sensors and associated data 818 are processed. The process mirrors the process described above with respect to FIG. 8B for environmental sensors, but with the addition of steps relating to the separate provision of personal health information (PHI), which may be subject to additional protections. A personal health information data storage device, such as a memory card, is provided 824. The personal health information data storage device is inserted 826 into the apparatus of the invention, so that its data can be uploaded 828 to the processor for use in the determination of safety alerts to be issued to the worker.

In some optional aspects of the invention, the sensor data regarding the environmental and personal health hazards detected by the sensors may be further processed if it is not above a limit or safety threshold, or has not reached a level of concern. In this way, even sensor data that is not over a safety threshold or within a level of concern can be further evaluated to assess risk. This can optionally result in providing information or alerts based on combinations of data that do not individually warrant an alert.

After the red, yellow, or optional green LED indications provided at the conclusion of the flow charts in FIGS. 8B-8C, the process continues as shown in the flow chart in FIG. 8A. Alerts and warning information are provided to the worker based on the data from each sensor in 850, 852, 854, 856, and 858. Based upon the alerts and warning information conveyed based on the sensor data, the worker may take corrective action. The corrective action will depend on the nature of the alert, so an action may be undertaken to address air quality issues 860, VOC issues 862, location issues 864, noise issues 866, and biomedical or personal health issues 868. Information regarding the correction may be provided by the user using the user interface, or may be based on updated data received from the sensors.

Depending on the type of alert and any corrective actions taken by the worker, a decision 870 regarding whether it is safe to continue working is undertaken. The decision may be made, for example, based on changes in readings from the sensor or sensors that resulted in the alert. If it is safe to continue working, for example, because the actions taken by the worker resolved the potential safety issue or because the warnings were of low-level hazards that the worker is permitted to clear at his/her discretion, the sensors may optionally be recalibrated (if sensor calibration is required), and the apparatus of the invention resumes collecting data 810, 812, 814, 816, 818 from the sensors. If it is not safe to continue working, for example, because the attempts at intervention did not resolve the safety issue or because the warnings were regarding hazards that cannot be cleared by the worker, then the process continues in FIG. 8D, and a shutdown procedure 880 is initiated.

Figure 8D:
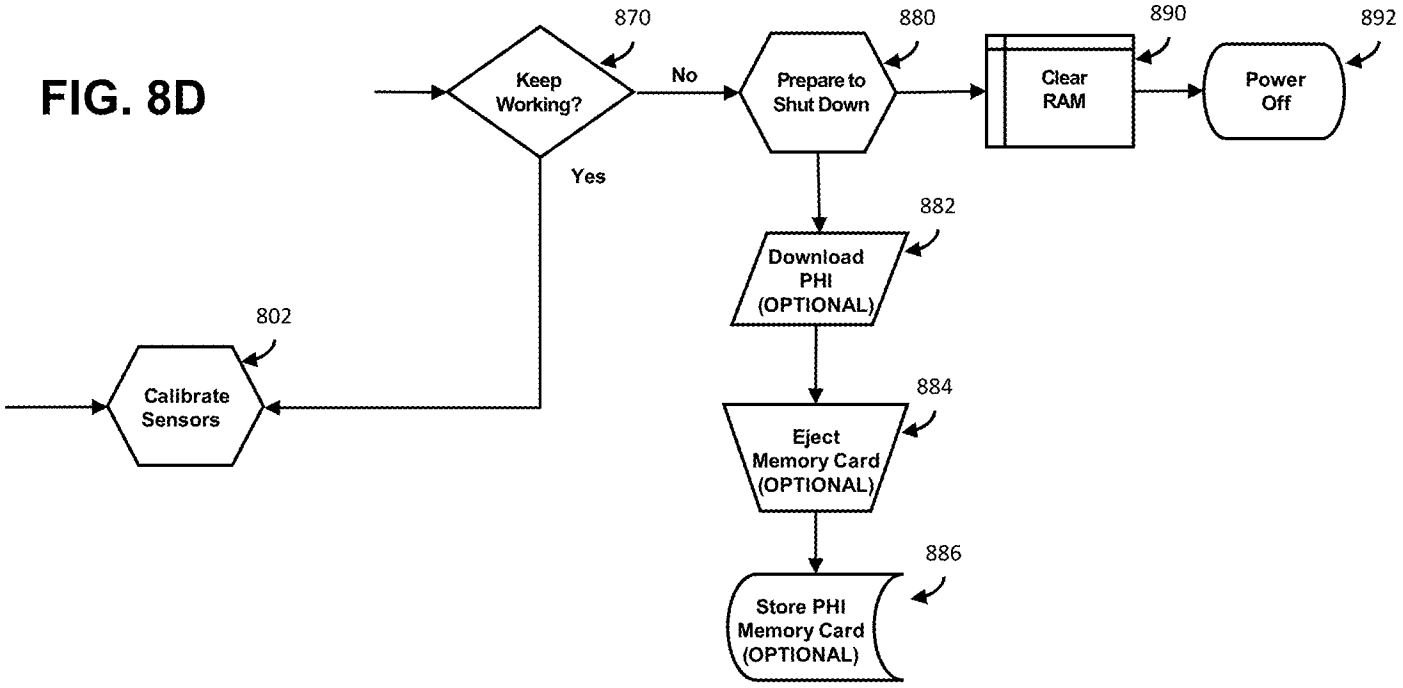

As shown in FIG. 8D, at the end of a work shift, or upon leaving a workspace after receiving an indication that it is not safe to continue working in response to decision point 870, the apparatus may be prepared for shut down 880. As part of the shutdown process 880, any personal health information may optionally be downloaded/stored 882 on the separate memory card (if provided) that is used to securely store the worker's personal health information. The memory card is then removed or ejected 884, and stored 886 by the worker or employer. The onboard memory module (e.g., RAM) is then cleared 890 to remove sensor data before the apparatus is powered off 890.

Once powered off, the apparatus may be maintained, such as by charging or replacing batteries, and changing onboard sensors as needed to accommodate the next work shift.

EXAMPLES

The invention will now be particularly described by way of example. However, it will be apparent to one skilled in the art that the specific details are not required in order to practice the invention. The following descriptions of specific embodiments of the present invention are presented for purposes of illustration and description. They are not intended to be exhaustive of or to limit the invention to the precise forms disclosed. Many modifications and variations are possible in view of the above teachings. The embodiments are shown and described in order to best explain the principles of the invention and its practical applications, to thereby enable others skilled in the art to best utilize the invention and various embodiments with various modifications as are suited to the particular use contemplated.

Example 1. Shipyard Use Case—Industrial Human Awareness Telemetry (iHAT) Device An exemplary use of an iHAT device during a normal work shift in a shipyard.

A. Shipyard Worker Arrives at the Ship Yard.

The Shipyard Central Tool Disbursement Point i.e., tool crib, will store, clean, and maintain the elements of the iHAT system (integrated circuit cards (ICCs) and Visual Display System (VDS). The tool crib will also maintain a supply of storage cards, batteries, and replacement gas sensors. These are preferably stored securely, to avoid tampering.

The tool crib, using its administrative-level privileges, at designated intervals will test the functions of iHAT and upgrades software/firmware as needed.

The shipyard worker arrives on site, receives a work assignment that includes a list of tools that will be issued to the worker to perform their assigned task. The worker then proceeds to the tool crib.

The worker presents their work assignment to the tool crib attendant. The attendant then gathers and assembles the iHAT components (that includes necessary wiring and USB interfaces), turns on the ICC and VDS devices, checks basic functions, and establishes the correct operating configuration for the worker. As part of establishing the configuration for that day, the tool crib will adjust alert levels depending on the job, the work location, the individual, and the other personal protective equipment (PPE) the worker will be using as listed in their work assignment. The tool crib logs the checkout of the assembled iHAT device.

The worker places the iHAT device in the correct location on their outer garments and installs any wires that could not be connected ahead of time by the tool crib.

The worker installs their personal data storage card and, upon prompting by iHAT, enters a password to be used for encrypting the data on the card.

The worker proceeds to the work site, where the shipyard safety inspector has already certified that the conditions in the work site meet applicable safety requirements.

B. Shipyard Worker Arrives at the Work Site.

Worker confirms that work conditions are appropriate before entering their assigned work space (inspection certificates are posted and current, visual check for unexpected physical access impediments, confirmation that iHAT sensors have not immediately detected unacceptable noise, light, or gases).

Worker proceeds to enter their assigned workspace and begins working. The worker need not pay any further attention to the iHAT until the end of the work shift unless an anomaly occurs. Anomalies include an iHAT-issued warning or alert, changing work conditions or location during a work shift, the addition or removal of PPE, or an unexpected iHAT shut down.

C. iHAT Device Normal Operating Mode.

The iHAT data integration and control software embedded on the ICC(s) polls each of the sensors for:

Ambient light (visual/IR sensor);
Ambient noise (microphone);
Ambient temperature and humidity;
Oxygen (optical fluorescence);
Carbon Monoxide (electrochemical);
VOCs (MOX);
Hydrocarbons (PID or flammable gas); and
Physiological vital signs (PPG).

iHAT will determine if ambient light, noise, and temperature conditions are green, yellow, or red. It will issue a yellow alert for noise levels (for example) in excess of the 8-hour limit of 90 dB and a red alert for noise limits in excess of the 15-minute limit of 115 dB. Alerts might be issued at the yellow level for light levels below twice the recommended minimum of 50 lux and at the red level for levels below the recommended minimum. The worker may also manually poll the iHAT at his own discretion to confirm the safety of the work site if desired.

iHAT will use temperature and humidity measurements to adjust gas readings. iHAT will confirm that the oxygen measurement is neither too high (22 percent) nor too low (19.5 percent). It will issue a yellow alert for levels more than 0.5 percent off normal value of 20.7-20.9 percent oxygen for several measurements (adjusted for ambient humidity and temperature). It will issue an immediate red alert if the value for percent oxygen is off by more than 1.2 percent.

iHAT will poll the carbon monoxide sensor at a frequency yet to be determined. For example, if the measurement is greater than one-half (or ⅔, or ¾, or other designated fraction) of the peak permissible exposure level (PEL) of 100 ppm, it will issue an immediate red alert to evacuate; if greater than half of the time-weighted average (TWA) PEL for 8 hours of 50 ppm (i.e., >25 ppm) it will issue a yellow alert.

iHAT may also seek to confirm the carbon monoxide reading with a more accurate but less discriminate VOC sensor reading (adjusted for humidity and temperature). It will subtract the earlier CO reading from the VOC sensor reading and calculate the ongoing average total VOC reading during the work shift. If it detects a reading of more than half of the typical VOC 8-hour TWA PEL of 100 ppm it will issue a yellow alert. A red alert will be issued if the value exceeds the typical VOC 8-hour TWA PEL.

iHAT will subtract the total VOC reading from a Photo-Ionization Detector (PID) or flammable gas sensor readings to determine if hydrocarbons not detected by the VOC sensor are present. If it determines that the average exposure level during the shift has exceeded more than half of the 8-hour TWA PEL for diesel fuel marine (the most toxic hydrocarbon on the Navy list), it will issue a yellow alert. An immediate red alert will be issued if the average during the shift exceeds the diesel fuel 8-hour TWA PEL (50 ppm).

iHAT will also measure heart rate, skin temperature, and blood pressure from a pulse oximeter sensor reading (PPG) used to monitors the perfusion of blood to the dermis and subcutaneous tissue of the skin. It will calculate a core temperature, and determine averages of these measurements over designated intervals (i.e., a 15 minute period, 30 minute period, 1 hour period). It will issue a yellow alert if any readings exceed first-level alert parameters (e.g., 150 heart beats per minute) for this individual for more than 30 seconds. It will issue an immediate red alert if parameters exceed second-level alert parameters (e.g., 180 beats per minute) for this individual for more than 30 seconds. Alerts based on levels over sustained intervals may also be issued.

iHAT records environmental measurements in main memory and stores physiological measurements on the worker's removable media.

D. Worker Response to iHAT-Issued Alerts.

As long as the alert levels remain green, the worker can ignore the iHAT system.

In the event of a yellow or red alert, the system will log the alert time and sensor readings. Yellow alerts will involve a change in the display color and some form of motion (for greater likelihood of drawing attention and to assist color blind individuals), a vibration alert, and perhaps repeated use of a flashing light. Red alerts will incorporate a buzzer as an additional level of tactile notification.

In the event of a red environmental alert, the worker should evacuate the work site and proceed to a pre-designated safe area to meet with management and/or a safety inspector for further guidance. The safety inspector, with iHAT configuration-level privileges, will inspect the iHAT device to obtain further information on the incident and/or reset the device to green status.

In the event of a red physiological alert, the worker should stop work, evacuate the space if possible, rest, and have colleagues notify shipyard medical response personnel.

In the event of a yellow alert, the worker should consider the circumstances: In some cases, the work can proceed but in a manner mindful of the possibility for worsening conditions. In other cases, with prompting from the iHAT, the worker might mitigate an apparent yellow environmental problem, for example, by increasing lighting or ventilation. The worker will also have pre-determined procedures for donning additional protective gear, such as a breathing apparatus or hearing protection. In the event of yellow physiological alerts, the worker will take a break for a previously agreed-to period of time and monitor further readings.

The worker, even with just iHAT user-level privileges, can be allowed to reset the device to green status but might be prevented from doing so after multiple alerts within a designated time period. The iHAT can be programmed in the wake of a sustained succession of yellow alerts, particularly for physiological alerts, to upgrade the alert status to red to force a reconsideration of the circumstances by managers and safety inspectors.

E. Worker Completes Shift and Prepares to Depart the Shipyard.

At the completion of the work shift, the shipyard worker returns the iHAT system to the tool crib.

The tool crib signs the encrypted physiological data using the shipyard's private signing key and returns the removable data storage card to the worker.

The tool crib signs and records environmental sensor and alert logs (including physiological alerts but not the actual physiological data), deletes files created during the work shift, and records the return of the iHAT device by the worker.

The tool crib turns off the device, determines if the device needs immediate maintenance, and returns it to ready inventory status.

It will, of course, be appreciated that the above description has been given by way of example only and that modifications in detail may be made within the scope of the present invention.

Throughout this application, various patents and publications have been cited. The disclosures of these patents and publications in their entireties are hereby incorporated by reference into this application, in order to more fully describe the state of the art to which this invention pertains.

The invention is capable of modification, alteration, and equivalents in form and function, as will occur to those ordinarily skilled in the pertinent arts having the benefit of this disclosure. While the present invention has been described with respect to what are presently considered the preferred embodiments, the invention is not so limited. To the contrary, the invention is intended to cover various modifications and equivalent arrangements included within the spirit and scope of the description provided above.

What is claimed:

1. Apparatus for detecting workplace hazards and displaying safety information, comprising:

a display;

environmental hazard sensors;

health hazard sensors;

removable storage media comprising biomedical data selected from a group consisting of biometric data, protected health information, cumulative exposure, personal risk thresholds, and combinations thereof;

a controller programmed to receive data from the environmental hazard sensors and health hazard sensors, compare the received data with safety thresholds for each environmental hazard and health hazard, determine each environmental hazard and health hazard that exceeds the safety thresholds, determine each environmental hazard and health hazard that is within 30% of the safety threshold, generate safety information for each environmental hazard and health hazard that exceeds or is within 30% of the safety thresholds, and activate a high risk mode and reduce safety thresholds for environmental and health hazards based on the biomedical data; and a transmitter configured to transmit the safety information to the display.

2. The apparatus of claim 1, where the environmental hazard sensors are selected from the group consisting of physical sensors, biological sensors, chemical sensors, radiological sensors, and combinations thereof.

3. The apparatus of claim 1, where the health hazard sensors are selected from the group consisting of body temperature, blood pressure, blood oxygen level, heart rate, respiration rate, and combinations thereof.

4. System for detecting workplace hazards and communicating safety information, comprising:

a display for safety information;

environmental hazard sensors;

health hazard sensors;

removable storage media comprising biomedical data selected from a group consisting of biometric data, protected health information, cumulative exposure, personal risk thresholds, and combinations thereof;

a controller programmed to receive data from the environmental hazard sensors and health hazard sensors, compare the received data with safety thresholds for each environmental hazard and health hazard, determine each environmental hazard and health hazard that exceeds the safety thresholds, determine each environmental hazard and health hazard that is within 30% of the safety threshold, generate safety information for each environmental hazard and health hazard that exceeds safety thresholds or is within 30% of the safety threshold, and activate a high risk mode and reduce safety thresholds for environmental and health hazards based on the biomedical data; and means for transmitting the safety information to the display.

5. The system of claim 4, where the environmental hazard sensors are selected from the group consisting of physical sensors, biological sensors, chemical sensors, radiological sensors, and combinations thereof.

6. The system of claim 4, where the health hazard sensors are selected from the group consisting of body temperature, blood pressure, blood oxygen level, heart rate, respiration rate, and combinations thereof.

7. The system of claim 4, further comprising updating biomedical data to reflect data received from the environmental hazard sensors and data received from the health hazard sensors.

8. The system of claim 4, further comprising storing the environmental hazard data, health hazard data, and safety information generated by the controller on the removable storage media.

9. Method for communicating workplace safety information to a worker, comprising:

providing sensors to monitor one or more environmental hazards associated with the workplace;

providing sensors to monitor one or more health hazards associated with the workplace;

providing biomedical data associated with the worker, where the biomedical data is selected from a group consisting of biometric data, protected health information, cumulative exposure, personal risk thresholds, and combinations thereof;

receiving data from environmental hazard sensors and health hazard sensors;

comparing the data from the environmental hazard sensors and health hazard sensors with safety thresholds for each environmental hazard and health hazard;

determining each environmental hazard and health hazard that exceeds the safety thresholds;

determining each environmental hazard and health hazard that is within 30% of the safety threshold;

communicating safety information to the worker for each environmental hazard and health hazard that exceeds safety thresholds or is within 30% of the safety threshold; and activating a high risk mode and reducing safety thresholds for environmental and health hazards based on the biomedical data.

10. The method of claim 9, where the environmental hazard sensors are selected from the group consisting of physical sensors, biological sensors, chemical sensors, radiological sensors, and combinations thereof.

11. The method of claim 9, where the health hazard sensors are selected from the group consisting of body temperature, blood pressure, blood oxygen level, heart rate, respiration rate, and combinations thereof.

12. The method of claim 9, further comprising summing data received from sensors detecting environmental hazards and health hazards over time; calculating a cumulative exposure of the worker for each environmental hazard and health hazard; and comparing the cumulative exposure of the worker against cumulative exposure safety thresholds.

13. The method of claim 9, further comprising comparing the data from the environmental hazard sensors and health hazard sensors with the biomedical data of the worker, and communicating safety information to the worker when a personal risk threshold is exceeded.

14. The method of claim 9, further comprising updating biomedical data associated with the worker to reflect data received from the environmental hazard sensors and data received from the health hazard sensors.

15. The method of claim 14, further comprising storing the updated biomedical data associated with the work on removable storage media.

* * * * *